US012618230B2

(12) United States Patent
Furre et al.

(10) Patent No.: US 12,618,230 B2
(45) Date of Patent: May 5, 2026

(54) RETENTION SYSTEM FOR A WEAR PART FOR A BUCKET FOR AN EARTH MOVING MACHINE

(71) Applicant: Hensley Industries Inc., Dallas, TX (US)

(72) Inventors: Arnold Furre, Sandnes (NO); Anuop Udayakumar, Klepp Stasjon (NO); Jean-Pierre Vidal Piesset, Klepp Stasjon (NO)

(73) Assignee: Hensley Industries Inc., Dallas, TX (US)

( * ) Notice: Subject to any disclaimer, the term of this patent is extended or adjusted under 35 U.S.C. 154(b) by 343 days.

(21) Appl. No.: 18/268,790

(22) PCT Filed: Jan. 25, 2022

(86) PCT No.: PCT/NO2022/050022

§ 371 (c)(1),
(2) Date: Jun. 21, 2023

(87) PCT Pub. No.: WO2022/173306

PCT Pub. Date: Aug. 18, 2022

(65) Prior Publication Data

US 2024/0191478 A1 Jun. 13, 2024

(30) Foreign Application Priority Data

Feb. 9, 2021 (NO) ..... 20210163

(51) Int. Cl.
*E02F 9/28* (2006.01)

(52) U.S. Cl.
CPC ..... *E02F 9/2833* (2013.01)

(58) Field of Classification Search
CPC ..... E02F 9/2833
See application file for complete search history.

(56) References Cited

U.S. PATENT DOCUMENTS 1,363,189 A * 12/1920 Mulroney ..... E02F 9/2825 37/455
4,180,926 A * 1/1980 Klett ..... E02F 9/2833 37/455

(Continued)

FOREIGN PATENT DOCUMENTS

EP 3604683 2/2020
GB 1485516 9/1977

(Continued)

OTHER PUBLICATIONS

Norwegian Search Report for NO 20210163, dated Jun. 9, 2021.
International Search Report and Written Opinion for PCT/NO2021/050265, dated Apr. 13, 2022.

*Primary Examiner* — Matthew R Buck
(74) *Attorney, Agent, or Firm* — Haynes and Boone, LLP

(57) ABSTRACT

A retention system is for a wear part for a bucket for an earth moving machine. The retention system has in operational use: i) a bucket body having a trench; ii) a force multiplier having a shape substantially corresponding to a shape of the trench; iii) a wear part mounted to an edge of the bucket body, and iv) a plurality of bolts. The wear part and the force multiplier is provided with at least one protrusion and another one of the wear part and the force multiplier is provided with at least one matching recess such that relative movement between the wear part and the force multiplier in a lateral direction parallel to the first mutual interface is prevented, in operational use, for reducing shear forces acting on the bolts.

21 Claims, 8 Drawing Sheets

(56) References Cited

U.S. PATENT DOCUMENTS

| | | | | |
|---|---|---|---|---|
| 7,770,310 | B2 * | 8/2010 | Keech | E02F 3/8155 37/455 |
| 8,281,505 | B2 * | 10/2012 | Karlsson | E02F 9/2858 37/446 |
| 2015/0247306 | A1 | 9/2015 | Kunz | |
| 2017/0089045 | A1 * | 3/2017 | Dare | E02F 9/2833 |
| 2019/0003156 | A1 | 1/2019 | Dare et al. | |

FOREIGN PATENT DOCUMENTS

| | | | |
|---|---|---|---|
| JP | S56105567 | | 8/1981 |
| SU | 905450 | | 2/1982 |
| WO | 2009082317 | | 7/2009 |
| WO | 2020251367 | A1 | 12/2020 |

* cited by examiner

RETENTION SYSTEM FOR A WEAR PART FOR A BUCKET FOR AN EARTH MOVING MACHINE

CROSS-REFERENCE TO RELATED APPLICATIONS

This application is the U.S. national stage application of International Application PCT/NO2022/050022, filed Jan. 25, 2022, which international application was published on Aug. 18, 2022, as International Publication WO 2022/173306 in the English language. The International Application claims priority of Norwegian Patent Application No. 20210163, filed Feb. 9, 2021. The international application and Norwegian application are both incorporated herein by reference, in entirety

FIELD OF THE INVENTION

The invention relates to a retention system for a wear part for a bucket for an earth moving machine, the retention system comprising a bucket body, a force multiplier, a wear part and a plurality of bolts. The invention also relates to the bucket body, the force multiplier and the wear part of the retention system as such.

BACKGROUND OF THE INVENTION

Retention assemblies for buckets for earth moving machines are known. One of the is-sues to be solved is the replacement of wear parts in such buckets. Several solutions for this problem have been reported.

International patent application publication WO2009/082317A1 discloses a wear part for a bucket to a loading or digging machine. The bucket is provided with at least one front edge plate with a forwardly directed engagement edge, wherein the wear part has a forward direction and a rearward direction and is provided with a hook portion for fixing of the wear part to the bucket. The fastening portion has a spanning surface portion for cooperating in a contact surface area with a clamping surface portion on a fastening unit which is positionable through a hole in said front edge plate. The spanning surface portion extends at an angle against said forward direction such that, in use, when tightening said fastening unit a force effecting the wear part in the rearward direction will occur. The document also discloses a fastening unit therefore and a wear part system, a bucket and a loading or digging machine.

US patent application publication US2019/0003156A1 discloses a wear member and fastener for securing the wear member to earth working equipment. The fastener can be in-stalled and maintained from the top of the assembly. An eccentric retainer is received in a recess of the wear member and is rotated to shift the wear member rearward on the earth working equipment. A bolt passing through aligned openings of the earth working equipment and the wear member is received by the retainer to secure the wear member to the earth working equipment.

Despite these developments there is still a need for safer and more reliable and strong retention systems, to achieve a higher system performance, ease of maintenance and extend the lifetime of wear parts.

In view of the above-described problems there is a need to further develop bucket assemblies.

SUMMARY OF THE INVENTION

The invention has for its object to remedy or to reduce at least one of the drawbacks of the prior art, or at least provide a useful alternative to prior art.

The object is achieved through features which are specified in the description below and in the claims that follow.

The invention is defined by the independent patent claims. The dependent claims define advantageous embodiments of the invention.

In a first aspect the invention relates to a retention system for a bucket for an earth moving machine. The retention system comprises in operational use:

- a bucket body comprising a trench having tilted sidewalls extending from an upper side of the bucket body, wherein a smallest lateral dimension of the trench is at a lower side of the bucket body opposite to the upper side;
- a force multiplier having a shape substantially corresponding to a shape of the trench, wherein the force multiplier is provided with a plurality of through-holes that are spaced apart and distributed over a first surface of the force multiplier, wherein the first surface is located at the upper side of the bucket body, the plurality of through-holes extending to a second surface at the lower side of the bucket body;
- a wear part mounted to an edge of the bucket body, wherein the wear part forms a first mutual interface with the bucket body extending from the edge over a predefined distance along the lower side of the bucket body beyond the location of the trench, wherein the wear part forms a second mutual interface with the edge of the bucket body, wherein the second mutual interface is under an angle with the first mutual interface, wherein the wear part is provided with a plurality of receiving holes having inner threads, wherein the receiving holes are located at locations corresponding to the plurality of through-holes in the force multiplier, and
- a plurality of bolts provided in the plurality of through-holes and retained by the inner threads of the plurality of receiving holes.

In the invention, one of the wear part and the force multiplier is provided with at least one protrusion at the first mutual interface and another one of the wear part and the force multiplier is provided with at least one matching recess at the first mutual interface such that relative movement between the wear part and the force multiplier in a lateral direction parallel to the first mutual interface is prevented, in operational use, for reducing shear forces acting on the bolts.

The effects of the features of the retention system in accordance with the invention are as follows. First, a key feature of the invention is the force multiplier having more than one through-holes, each hole capable of receiving a respective bolt. This feature simplifies the retention system by reducing the number of components, but it also renders the system much stronger, i.e., it tolerates much larger forces. Second, the force multiplier and the wear part are provided with shear-force reducing feature by providing one of them with at least one protrusion at the first mutual interface and the other one with at least one matching recess (in an embodiment axially aligned with the hole for the bolt). In some embodiments this protrusion and recess also have a centralizing function. Third, the force multiplier and the trench in the bucket body are shaped with tilted sidewalls such that tightening the bolts in the holes of the bucket body in case of an offset wear part causes the wear part to be pushed towards its correct position, i.e., the force multiplier is, because of its shape and the shape of the trench, provided with an alignment function. Fourth, the force multiplier in the invention virtually acts as one large bolt when being placed in the trench of the bucket body and tightened to the wear part. Fifth, the design of the retention system renders it possible to prevent any parts extending beyond the surfaces of the bucket body or the wear part. This feature will be elaborated upon in the description of the figures.

In order to facilitate understanding of the invention one or more expressions are further defined hereinafter.

The wording "bolt" must be interpreted as an axial force transmitter, which could comprise types of screws, rivets, magnets, plug-pin connectors, or hydraulic piston connectors.

The wording "force multiplier" must be interpreted as a part which holds/retains the bolts. In the invention it only needs to have holes that are shaped to receive the bolts. The holes in the bolt retainer do not need to have inner threads. In fact, it is advantageous if the holes do not have inner threads, as that facilitates tensioning between the force multiplier and the wear part by simply tensioning the bolts from the upper side of the bucket body.

The wording "upper side" must be interpreted as the side of the respective part that faces the upward direction (towards the sky) in normal operational use.

The wording "lower side" must be interpreted as the side of the respective part that faces the downward direction (towards the ground) in normal operational use.

The wording "earth moving machine" must be interpreted as a machine that is typically used for moving and digging material, such as ground, dirty, waste, sand, wood, rocks, soil, etc.

In an embodiment of the retention system according to the invention the shape and location of the trench and the location of the holes are chosen such that after mounting of the retention system there is substantially no gap between the wear part and the bucket body. In this embodiment the shape and location of the trench including the distance from the edge of the bucket body is matched with the location of the holes through the force multiplier and the wear part such that, when the force multiplier is placed inside the trench and screwed to the wear part, respective surfaces of the second mutual interface are touching each other without forming a gap between them. This is embodiment conveniently prevents material (such as dirt) to be collected between the wear part and the bucket body.

In an embodiment of the retention system according to the invention the force multiplier is an elongated body and wherein the trench is an elongated trench. A force multiplier having an elongated body fits very well on a bucket body having an edge on which an elongated wear part has been provided.

In an embodiment of the retention system according to the invention the holes and the least one protrusion are axially aligned. Axial alignment of the holes and the protrusion means that the protrusion is implemented around the holes such that their centres overlap or coincide. The advantage of this embodiment is that it the system is easier to manufacture. For instance, while drilling the hole in the force multiplier it is relatively easy to form a recess around the hole that is shaped for receiving the protrusion of the wear part that is formed around the hole in the wear part. Alternatively, in another embodiment, while drilling a hole in the wear part a recess may be formed around the hole that is shaped for receiving the protrusion that is formed around the hole in the force multiplier. The figures will further illustrate what is meant with axial alignment between the holes and the protrusion (and recesses).

In an embodiment of the retention system according to the invention the at least one protrusion comprises an elongated protrusion enclosing two or more receiving holes. This embodiment constitutes a first main variant of the invention. The implication of this embodiment is that, in the embodiment wherein the wear part is provided with the protrusion and the force multiplier with the recess, the wear part is provided with an elongated protrusion in which at least two holes are formed. In addition, the force multiplier will, at its bottom side, have an elongated recess formed around the plurality of holes, to make the force multiplier fit the wear part. In another variant, the elongated recess is formed on the wear part and the elongated protrusion is formed on the bottom side of the force multiplier. This embodiment will be discussed more elaborately with reference to the figures.

In an embodiment of the retention system according to the invention the at least one protrusion comprises two or more protrusions, each protrusion having at least one receiving hole. This embodiment constitutes a second main variant of the invention. The implication of this embodiment is that, in the embodiment wherein the wear part is provided with the protrusion and the force multiplier with the recess, the wear part is provided with a plurality of protrusions each in which a respective hole is formed. In addition, the force multiplier will, at its bottom side, have a plurality of recesses, each recess formed around a respective hole, to make the force multiplier fit the wear part. In another variant, the plurality of recesses is formed on the wear part and the plurality of protrusions is formed on the bottom side of the force multiplier. This embodiment will be discussed more elaborately with reference to the figures.

In a second aspect the invention relates to the bucket body of the retention system according to the first aspect of the invention, wherein the bucket body is configured for cooperating with the force multiplier and the wear part. The system comprises three main parts in addition to the bolts, including the bucket body, the wear part and the force multiplier. All three parts are characterized and configured to cooperate in the way as explained in this application. Each part may be sold separately and therefore the applicant is entitled to claims directed to the bucket body as well.

In a third aspect the invention relates to the force multiplier of the retention system according to the first aspect of the invention, wherein the force multiplier is configured for cooperating with the bucket body and the wear part. The system comprises three main parts in addition to the bolts, including the bucket body, the wear part and the force multiplier. All three parts are characterized and configured to cooperate in the way as explained in this application. Each part may be sold separately and therefore the applicant is entitled to claims directed to the force multiplier as well.

In a fourth aspect the invention relates to the wear part of the retention system according to the first aspect of the invention, wherein the wear part is configured for cooperating with the bucket body and the force multiplier. The system comprises three main parts in addition to the bolts, including the bucket body, the wear part and the force multiplier. All three parts are characterized and configured to cooperate in the way as explained in this application. Each part may be sold separately and therefore the applicant is entitled to claims directed to the wear part as well.

In a fifth aspect the invention relates to a bucket comprising the retention system according to the first aspect of the invention. The bucket constitutes a convenient application of the invention.

In a sixth aspect the invention relates to a earth moving machine comprising the bucket according to the fifth aspect of the invention. The earth moving machine constitutes a convenient application of the invention.

BRIEF INTRODUCTION OF THE FIGURES

In the following is described examples of embodiments illustrated in the accompanying figures, wherein.

Figure 1:
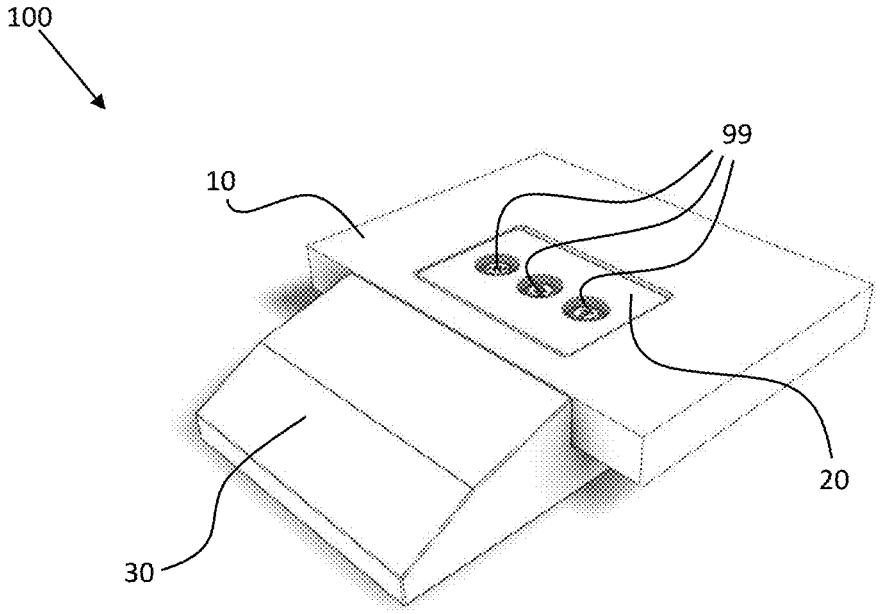
FIG. 1 shows an embodiment of a retention system in accordance with the invention when fully assembled.
Figure 3:
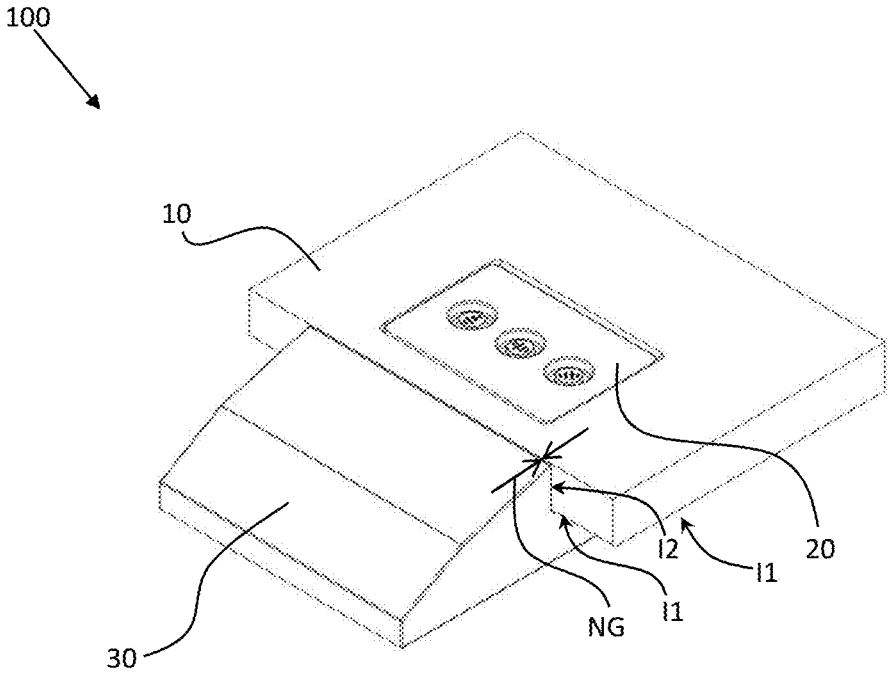
Figure 4:
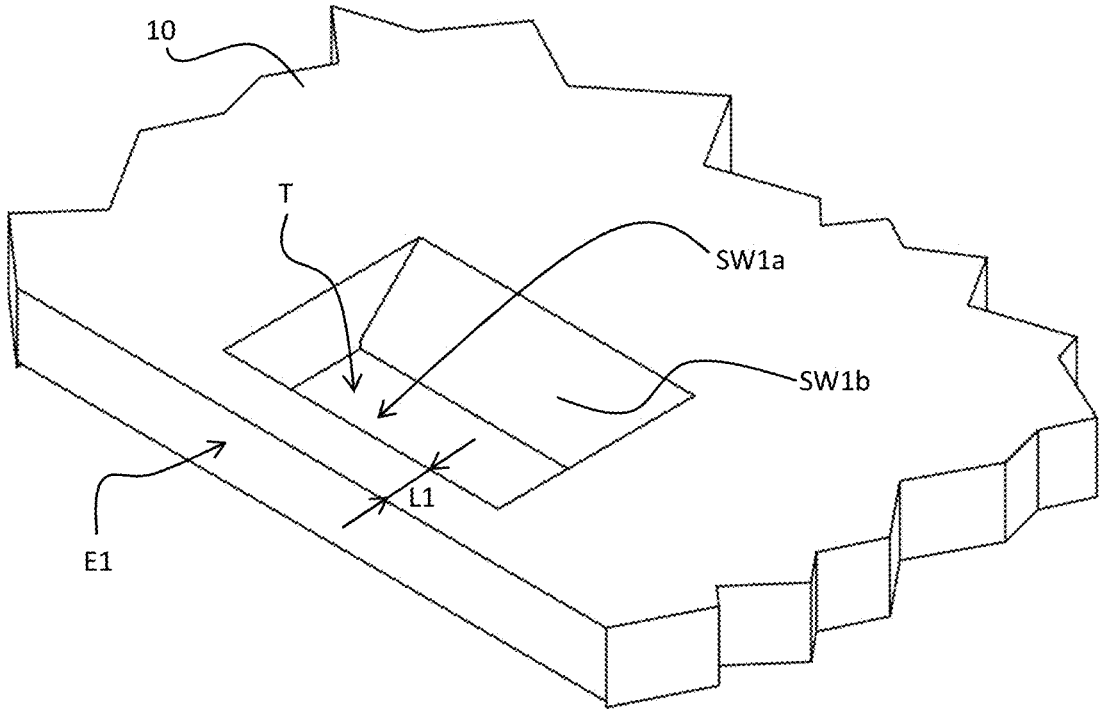
Figure 5:
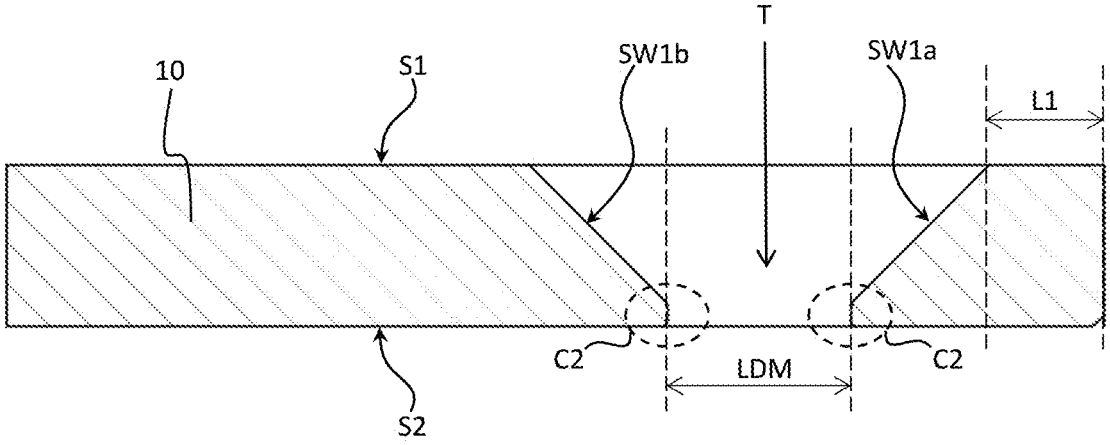
Figure 6:
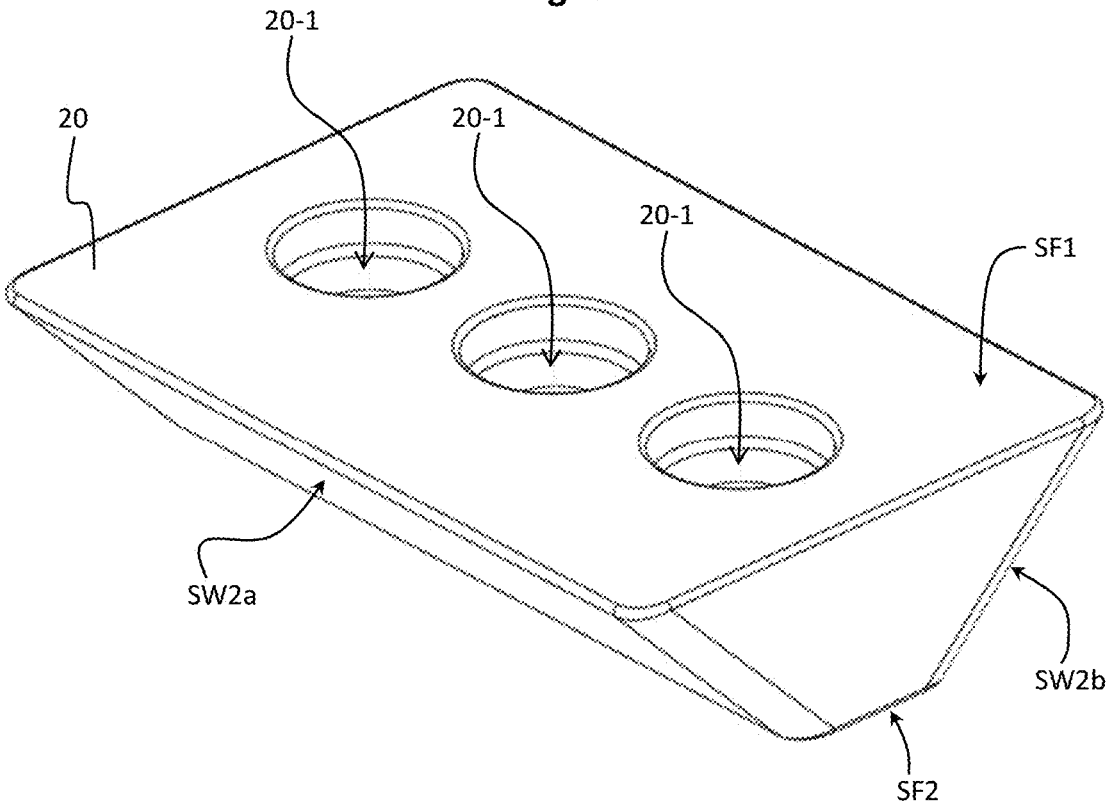
Figure 7:
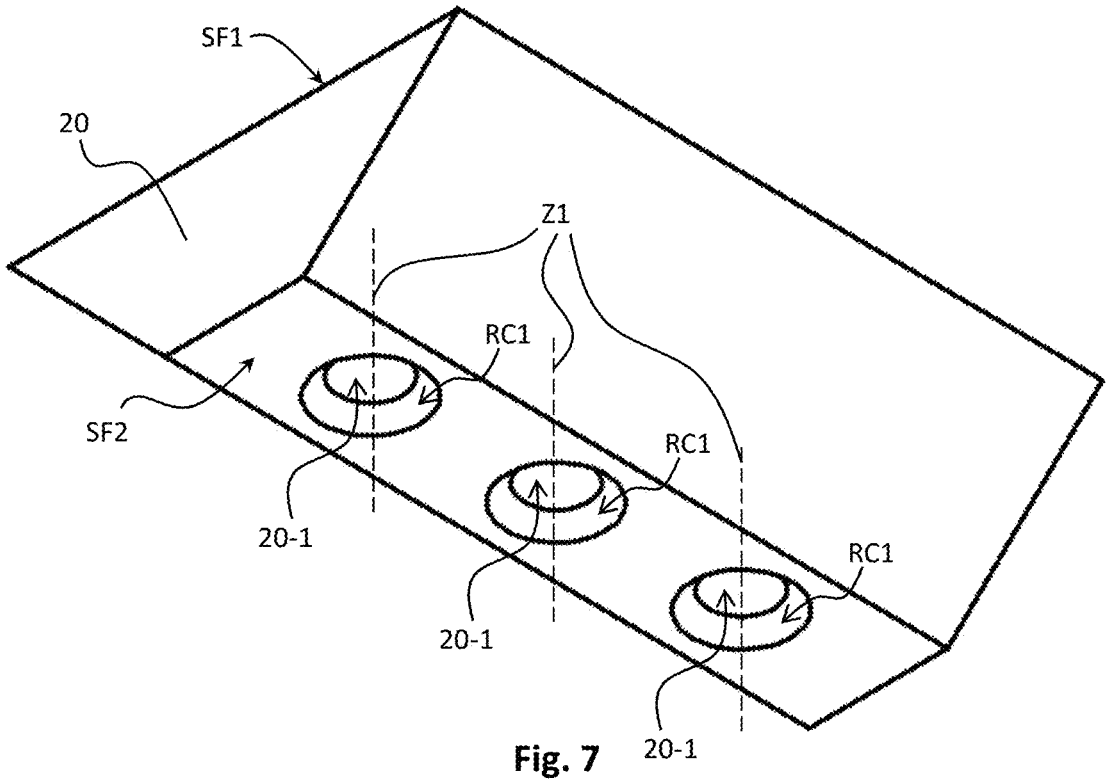
Figure 8:
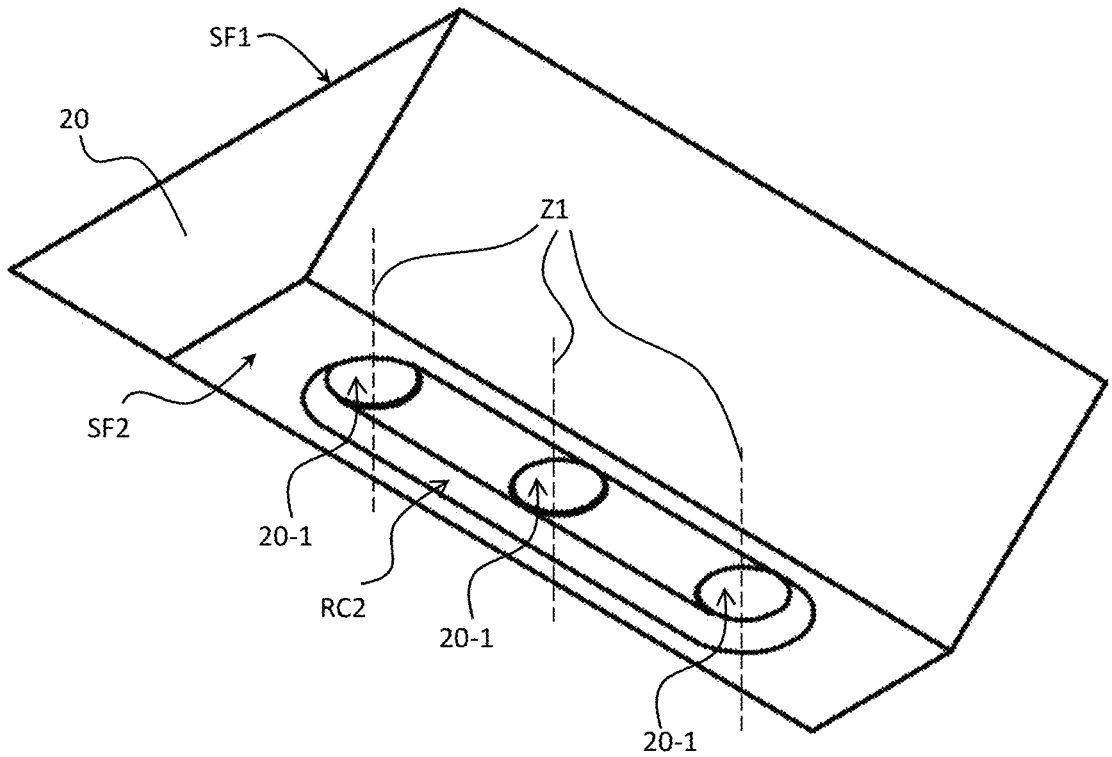
Figure 9:
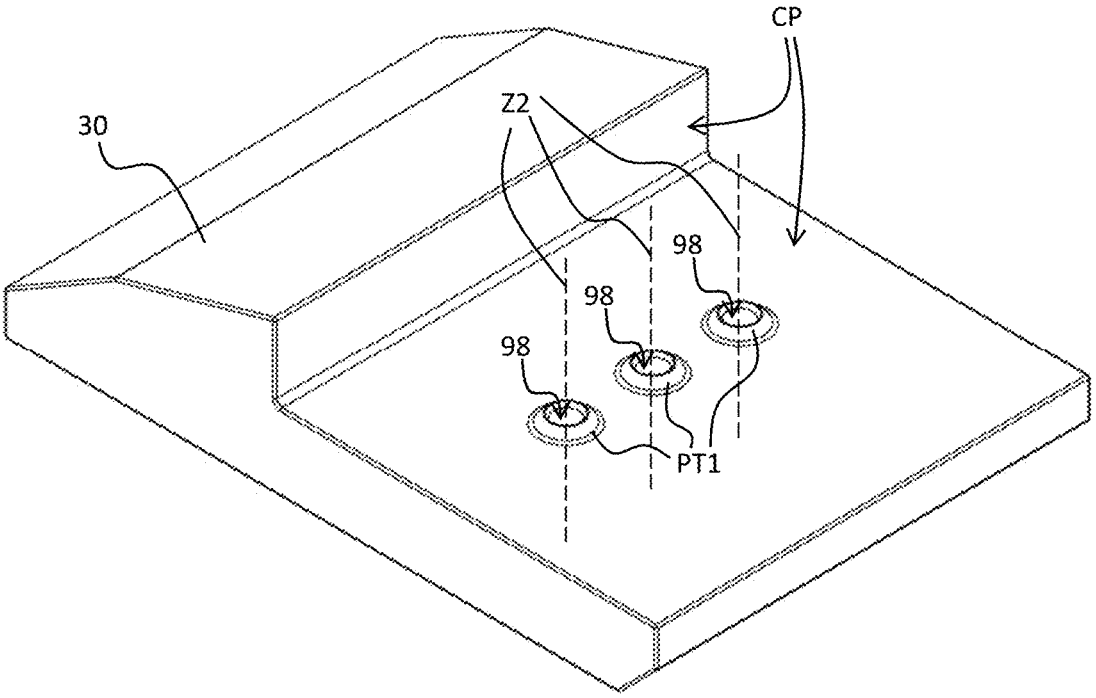
Figure 10:
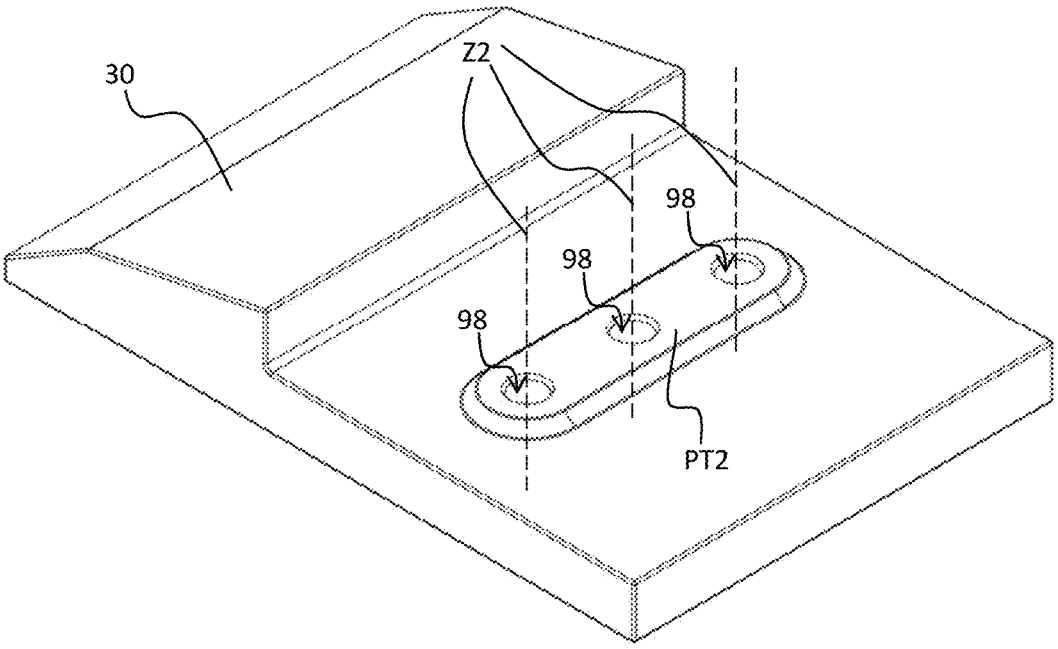
Figure 11:
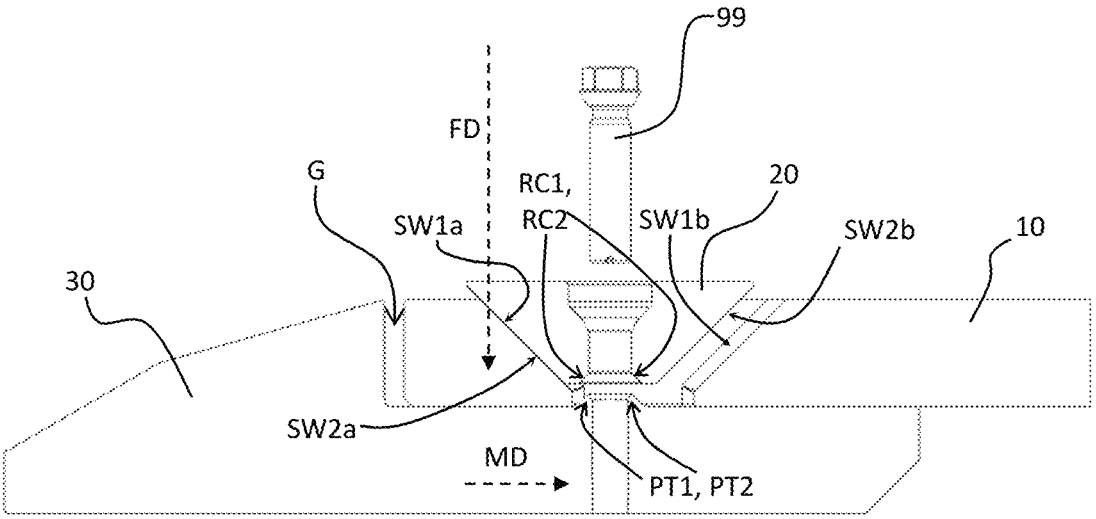
Figure 12:
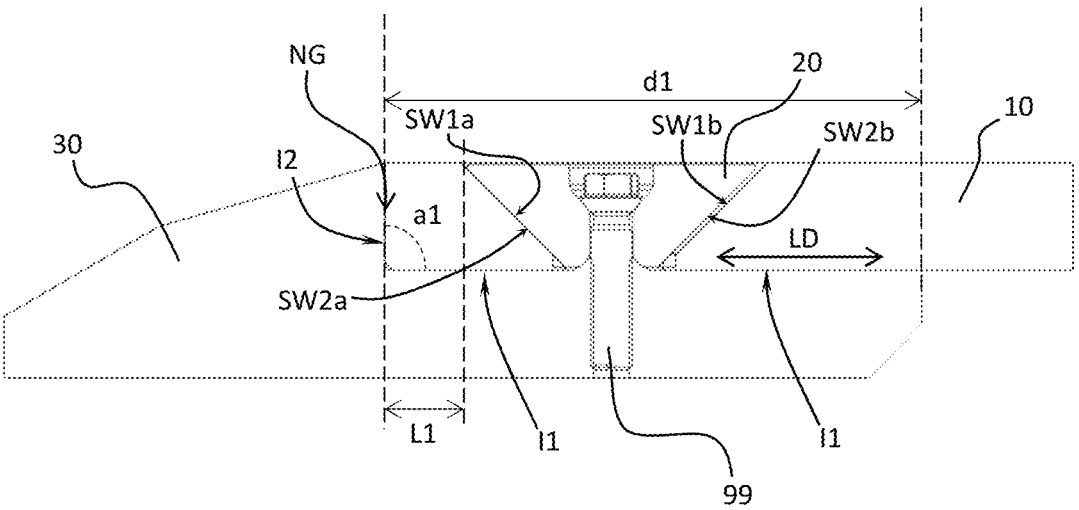
Figure 13:
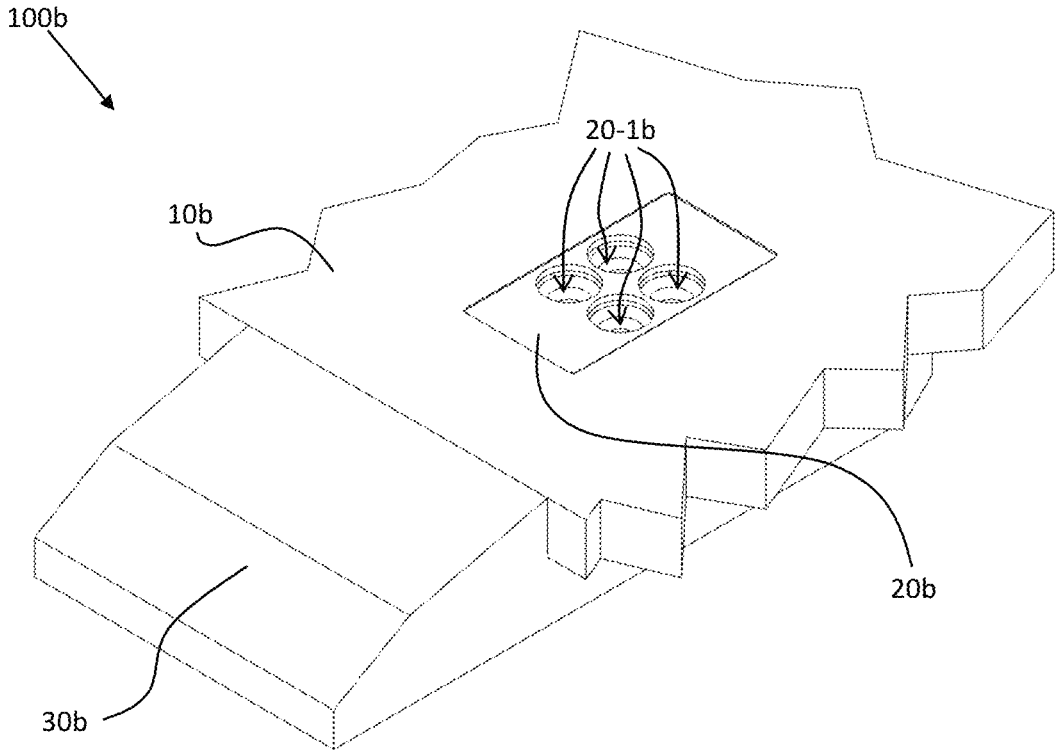
Figure 14:
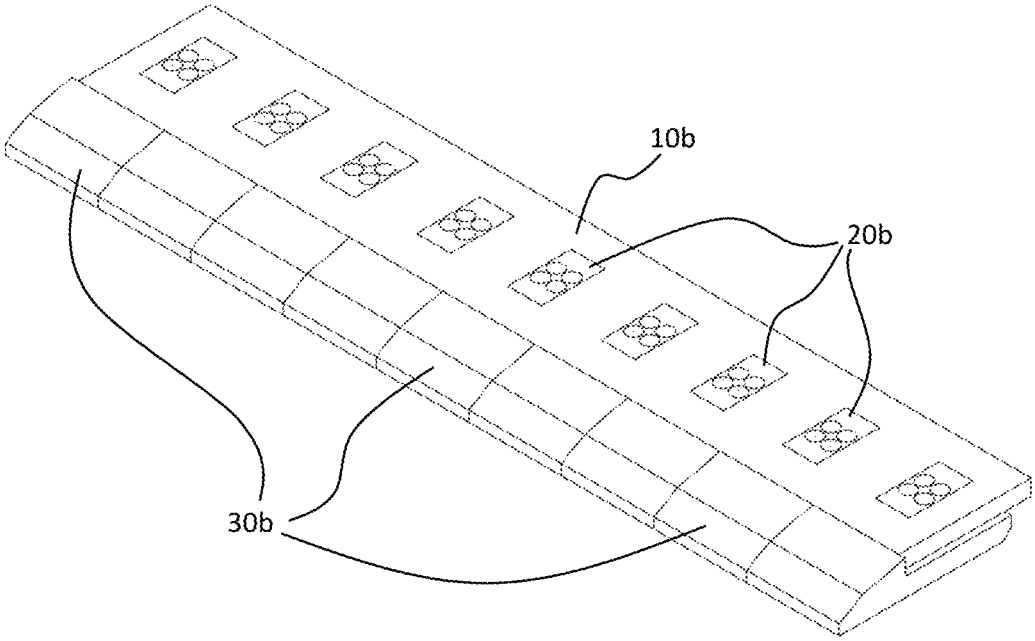
Figure 15:
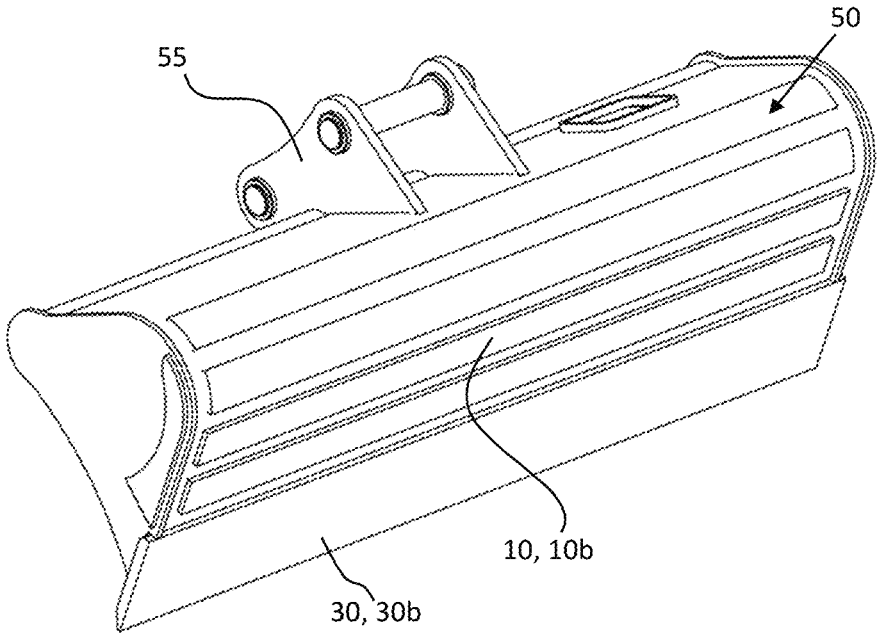

FIG. 3 repeats the retention system of FIG. 1 and illustrates some further aspects of the invention;

FIG. 4 shows a bucket body that is a part of the retention system of FIG. 3;

FIG. 5 shows a cross-sectional view of the bucket body of FIG. 4;

FIG. 6 shows a force multiplier that is part of the retention system of FIG. 3;

FIG. 7 shows a first embodiment of the force multiplier of FIG. 6 seen from the bottom;

FIG. 8 shows a second embodiment of the force multiplier of FIG. 6 seen from the bottom;

FIG. 9 shows a first embodiment of a wear part that is part of the retention system of FIG. 3, which embodiment is configured for operating with the force multiplier of FIG. 7;

FIG. 10 shows a second embodiment of a wear part that is part of the retention system of FIG. 3, which embodiment is configured for operating with the force multiplier of FIG. 8;

FIG. 11 shows a cross-sectional view of the retention system of FIG. 3 in a stage before full assembly;

FIG. 12 shows a cross-sectional view of the retention system of FIG. 3 when fully assembled;

FIG. 13 shows second embodiment of a retention system in accordance with the invention;

FIG. 14 shows a cutting edge of a bucket comprising a plurality of retention assemblies like FIG. 13;

FIG. 15 shows a bucket onto which the invention may be applied, and

Figure 16:
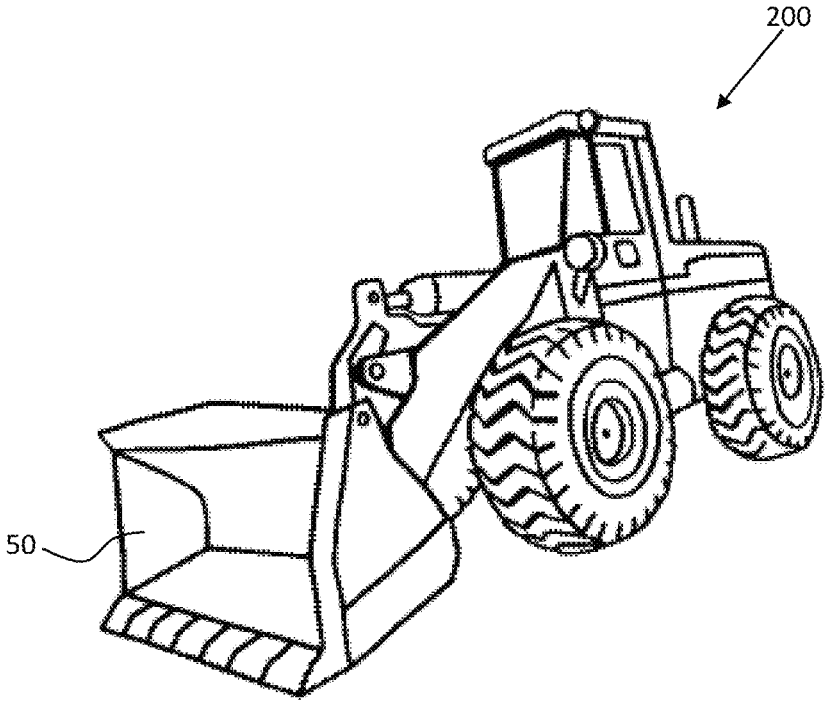

FIG. 16 shows an earth moving machine comprising a bucket onto which the invention may be applied.

DETAILED DESCRIPTION OF THE EMBODIMENTS

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the develop-ers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present subject matter will now be described with reference to the attached figures. Various systems, structures and devices are schematically depicted in the figures for purposes of explanation only and to not obscure the present disclosure with details that are well known to those skilled in the art. Nevertheless, the attached figures are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The invention will be discussed in more detail with reference to the figures. The figures will be mainly discussed in as far is they differ from previous figures.

FIG. 1 shows an embodiment of a retention system 100 in accordance with the invention when fully assembled. The figure shows the main parts, which are a bucket body 10, a force multiplier 20, a wear part 30 and a plurality of bolts 99 (also referred to as tensors), as illustrated. It must be noted that the only part of the bucket body 10 is illustrated. The bucket body 10 tends to wear during operational use and in order to reduce this wear typically the wear part 30 is mounted to the bucket body 10, wherein the wear part 30 serves to protect the bucket body 10. An important aspect of the invention resides in the force multiplier 20, which is prepared for receiving the plurality of bolts 99. In this embodiment three bolts are drawn, but this may be any other number of bolts, but at least two. The force multiplier 20 is an elongated body as illustrated. However, in practically embodiment it may be even more elongated than illustrated in this figure. In fact, it may be stretching substantially along a full length of a side of the bucket body 10. Alternatively, there may be a plurality of force multipliers 20 as illustrated in FIG. 1 spaced apart from each other and provided along substantially a full length of an edge of the bucket body 10. In yet other embodiments also other sides of the bucket body 10 may be provided with wear parts similar as illustrated in FIG. 1. Expressed differently, the invention may be repeated as much as desired and applied at various edges of bucket bodies wherever desired.

Figure 2:
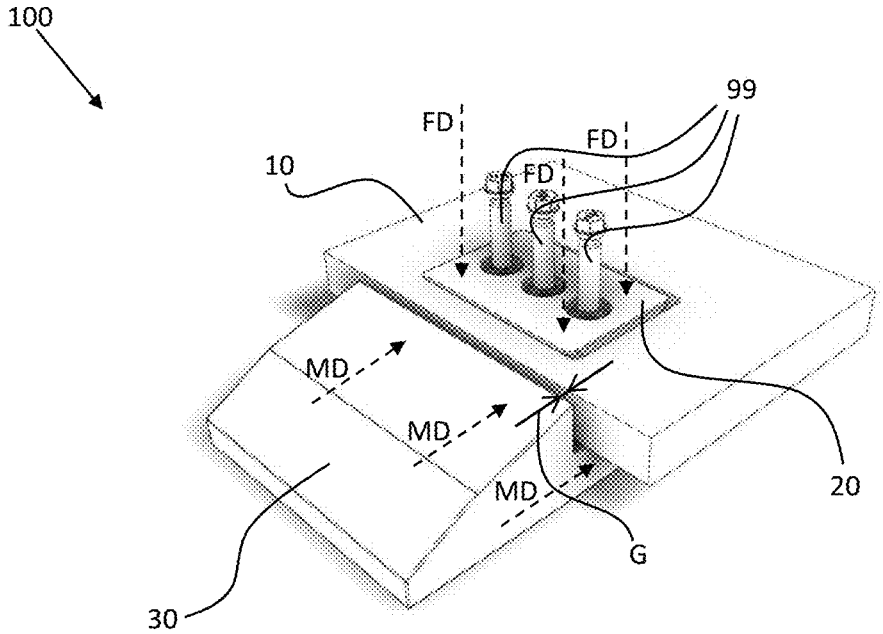
FIG. 2 shows the retention system of FIG. 1 in a stage before full assembly.

FIG. 2 shows the retention system 100 of FIG. 1 in a stage before full assembly. In this figure the bolts 99 are not yet fully provided the force multiplier 20 and the force multiplier 20 is not yet fully pushed in the bucket body 10. It can be observed that in this stage there is a gap G between the bucket body 10 and the wear part 30. When the bolts or tensors 99 are pushed down and tightened they will apply a downward directed force FD on the force multiplier 20 as illustrated. The force multiplier 20 and a corresponding trench in the bucket body 10 are shaped such that when that happens the wear part 30 is pulled towards the bucket body 10 in a movement direction MD as illustrated.

FIG. 3 repeats the retention system 100 of FIG. 1 and illustrates some further aspects of the invention. The bolts 99 are tightened in this stage and there is clearly no gap NG between the bucket body 10 and the wear part 30. In this stage there is a first mutual interface I1 between the bucket body 10 and the wear part 30, which has an L-shaped corner profile for receiving the bucket body 10. Furthermore, there is a second mutual interface I2 between the bucket body 10 and the wear part 30 that makes an angle with the first mutual interface I1. In this example the angle is 90 degrees, but it does not need to be. This will be further explained with reference to other figures. The second mutual interface I2 also contributes to shear force reduction in case the wear part 30 is pushed in the direction of the bucket body 10.

FIG. 4 shows a bucket body 10 that is a part of the retention system 100 of FIG. 3. This figure serves to illustrate the earlier-mentioned trench T and its special shape having the tilted side walls SW1. The trench is formed at a distance L1 from an edge E1 of the bucket body.

FIG. 5 shows a cross-sectional view of the bucket body 10 of FIG. 4. This figure illustrates that the trench T is formed with the tilted sidewalls SW1*a*, SW1*b* such that a largest lateral dimension of the trench is at an upper side S1 of the bucket body, when operationally used. A smallest lateral dimension LDM is at the lower side S2 opposite to the upper side S1, as illustrated. The sidewalls SW1*a*, SW1*b* further comprise some machined corners C1, C2 at the lower side S2.

FIG. 6 shows a force multiplier 20 that is part of the retention system 100 of FIG. 3. The force multiplier 20 is shaped to substantially fit the shape of the trench T except the machined corners C1, C2, i.e., the force multiplier 20 comprises matching tilted sidewalls SW2*a*, SW2*b* with the sidewalls SW1*a*, SW2*b* of the trench T. The reason for the force multiplier 20 not having a shape exactly following the machined corners of the sidewalls of the trench T is that this facilitates the insertion and sliding of the force multiplier 20 into the trench T.

The force multiplier in FIG. 6 has a plurality of through-holes 20-1 at its first surface SF1 at the top side, which extend to the second surface SF2 at the bottom side.

As already mentioned in the introduction one of the goals of the retention system of the invention is to reduce shear forces acting on bolts. In order to reduce these forces one of the surfaces of the interface needs to be provided by a protrusion, while another one of the surfaces of the interface needs to be provided by a matching recess. In the invention this means that the earlier-mentioned first mutual interface I1 (FIG. 3) between the force multiplier 20 and the wear part 30 is provided with such protrusion and corresponding recess. The inventor developed two main embodiments of such mutual interface, which are illustrated in FIGS. 7 and 9 on one hand and FIGS. 8 and 10 on the other hand.

FIG. 7 shows a first embodiment of the force multiplier 20 of FIG. 6 seen from the bottom. In this embodiment the second surface of the force multiplier 20 is provided with a plurality of recesses RC1 that are aligned with the through-holes 20-1 as illustrated. The alignment basically means that through-holes 20-1 have axial axes as illustrated that fall within the recesses RC1 as illustrated.

It must be stressed that alignment is not essential, i.e., the protrusions and recesses may also be designed outside the holes 20-1, if there is place for that. However, aligning the protrusions and recesses with the holes 20-1 make manufacturing of the system easier.

FIG. 8 shows a second embodiment of the force multiplier 20 of FIG. 6 seen from the bottom. The main difference between this embodiment and the previous embodiment is that there is now provided one large recess RC2 all around the through-holes 20-1. Yet still the large recess RC2 is aligned with the through-holes 20-1. The alignment basically means that through-holes 20-1 have axial axes Z1 as illustrated that fall within the large recess RC2 as illustrated. This embodiment of FIG. 8 will work equally well as the embodiment of FIG. 7. It will be appreciated that the protrusions on the wear part 30 need to be adapted accordingly, depending on the embodiment choses for the force multiplier 20. The next figures illustrate this.

FIG. 9 shows a first embodiment of a wear part 30 that is part of the retention system 100 of FIG. 3, which embodiment is configured for operating with the force multiplier 20 of FIG. 7. The wear part 30 shows a plurality of individual protrusions PT1, each protrusion PT1 aligned with respective receiving holes 98 that are dimensioned and positioned to match with the earlier-mentioned through-holes 20-1 of FIGS. 7 and 8. The alignment basically means that receiving holes 98 have axial axes Z2 that fall within the protrusions PT1 as illustrated. The wear part 30 is provided with the earlier-mentioned L-shaped corner profile CP for receiving the bucket body 10. The wear part 30 may have different shapes.

FIG. 10 shows a second embodiment of a wear part 30 that is part of the retention system 100 of FIG. 3, which embodiment is configured for operating with the force multiplier 20 of FIG. 8. The main difference between this embodiment and the previous embodiment is that there is now provided one large protrusion PT2 all around the receiving holes 98 yet aligned with it. The alignment basically means that receiving holes 98 have axial axes Z2 that fall within the large protrusion PT2 as illustrated. The embodiment of FIG. 10 will work equally well as the embodiment of FIG. 9.

It must be stressed that the receiving holes 98 in the wear part 30 are provided with inner threads (not visible in the drawing) for receiving the bolts 99. The advantage of this is that no nuts are required on the bolts. The combination with the shear force reducing effects of the specially designed mutual interface I1 between the force multiplier 20 and the wear part 30 provides a very robust and low-wear solution. The retention system can be designed without any parts sticking out as also is clearly illustrated in the following figures.

FIG. 11 shows a cross-sectional view of the retention system 100 of FIG. 3 in a stage before full assembly. FIG. 12 shows a cross-sectional view of the retention system 100 of FIG. 3 when fully assembled. These figures primarily serve to illustrate the earlier mentioned sliding effect of the wear part 30 during mounting and tightening the force multiplier with the bolts 99. In FIG. 11 there is a gap G while in FIG. 12 there is no gap NG. It must be stressed that the position of FIG. 11 is not mandatory when mounting the retention system, but the figure serve to illustrate that during mounting and tightening the alignment of the parts is not critical and that any gap G will automatically disappear during tightening of the bolts. During the earlier mentioned sliding effect, the respective sidewall SW2*a* of the force multiplier 20 slides over the respective sidewall SW1*a* of the trench. During this sliding moment the gap G slowly disappears and a gap between the opposite sidewalls SW1*b*, SW2*b* gradually gets smaller. However, the latter gap does not need to disappear completely. It may disappear but this is not essential. It is important however that, after mounting there is no gap between the first-mentioned sidewalls SW1*a*, SW2*b*, as illustrated, such that the wear part 30 is properly pressed against the edge of the bucket body 10 at the second mutual interface I2. Obviously, these technical features require proper dimensioning of the shapes and positions of the force multiplier 20, the trench T and the holes 20-1, 98.

FIG. 12 also serves to illustrate what the claims mean with the term "predefined distance" d1 along which the wear part 30 extends along the lower side of the bucket body 10. Furthermore, the figure illustrates what is meant with the angle a1 between the first mutual interface I1 and the second mutual interface I2. The second mutual interface I2 also contributes to shear force reduction in case the wear part 30 is pushed in the direction of the bucket body 10. In the current examples this angle a1 is 90 degrees, but it does not need to be, i.e., it may form both sharp as well as blunt angles. In addition, arrow LD illustrates in which directions shear forces on the bolts 99 are reduced. It must be stressed that shear forces are also reduced in directions perpendicular to this lateral direction, which is because the protrusions and recesses are extending in two dimensions parallel to the mutual interface I1. Expressed differently, shear forces are reduced in all direction parallel to the mutual interface I1.

FIG. 13 shows second embodiment of a retention system 100*b* in accordance with the invention. Many variations are possible in the current invention. For example, the number of holes and bolts in the force multiplier and wear part may be varied as FIG. 13 illustrates. In this embodiment of the retention system 100*b* the force multiplier 20*b* is provided with an array of two-by-two through-holes 20-1*b*. These through-holes 20-1*b* extend through the force multiplier 20*b* and in the wear part 30*b* that is provided with corresponding receiving holes (not shown). It must be noted that the bucket body 10*b* needs to be adapted as well by providing a trench that is adapted in size. In addition, the force multiplier 20*b* needs to be resized as well to accommodate the bolts in a centre part of it (not having the tilted sidewalls). The embodiment of FIG. 13 is just one example out of a virtually unlimited number of embodiments, each embodiment having a different number of bolts and holes, different placement of the bolts and holes. The invention covers all variants as long as the force multiplier has more than one bolt-hole combination.

FIG. 14 shows a cutting edge of a bucket comprising a plurality of retention assemblies 100*b* similar to FIG. 13. Like FIG. 13 the number of possible variations is virtually unlimited. This concerns the number of wear parts 30*b*, the distance between the wear parts 30*b*, the shaped of the wear parts 30*b*, the shape of the bucket body 10*b*, the number of force multipliers 20*b*, the shape of the force multipliers 20*b*, and the number and placement of the holes and bolts.

FIG. 15 shows a bucket 50 onto which the invention may be applied. This figure serves to illustrate what is meant with the cutting edge of the bucket 50. It is this cutting edge, which may benefit from the invention by applying the wear parts 30, 30*b* on the cutting edge of the bucket body 10, 10*b* as illustrated. For completeness also the bucket handle 55 is indicated in the figure.

FIG. 16 shows an earth moving machine 200 comprising a bucket 50 onto which the invention may be applied. This is just an example of an excavator machine having the bucket 50, which may be provided with the retention system of the invention, but it may be any other kind of earth moving machine as well.

The embodiments disclosed above are illustrative only, as the invention may be modified and practiced in different but equivalent manners apparent to those skilled in the art having the benefit of the teachings herein.

For example, the second mutual interface may have different shapes, and may comprise multiple surfaces that are under an angle with each other.

The person skilled in the art may easily find alternative solutions for certain technical functions and solutions. The invention covers all these variants as long as they are covered by the independent claims. No limitations are intended to the details of earth moving or design herein shown, other than as described in the claims below. It is therefore evident that the particular embodiments disclosed above may be altered or modified and all such variations are considered within the scope of the invention. Accordingly, the protection sought herein is as set forth in the claims below.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. The invention may be implemented by means of hardware comprising several distinct elements, and by means of a suitably programmed computer. In the device claims enumerating several means, several of these means may be embodied by one and the same item of hardware.

The invention claimed is:

1. A retention system for a wear part for a bucket for an earth moving machine, the retention system comprising:

a bucket body comprising a trench having tilted sidewalls extending from an upper side of the bucket body, wherein a smallest lateral dimension of the trench is at a lower side of the bucket body opposite to the upper side;

a force multiplier having a shape substantially corresponding to a shape of the trench, wherein the force multiplier is provided with a plurality of through-holes that are spaced apart and distributed over a first surface of the force multiplier, wherein the first surface is located at the upper side of the bucket body, the plurality of through-holes extending to a second surface at the lower side of the bucket body;

a wear part mounted to an edge of the bucket body, wherein the wear part forms a first mutual interface with the bucket body extending from the edge over a predefined distance along the lower side of the bucket body beyond the location of the trench, wherein the wear part forms a second mutual interface with the edge of the bucket body, wherein the second mutual interface is under an angle with the first mutual interface, wherein the wear part is provided with a plurality of receiving holes having inner threads, wherein the receiving holes are located at locations corresponding to the plurality of through-holes in the force multiplier, and a plurality of bolts provided in the plurality of through-holes and retained by the inner threads of the plurality of receiving holes.

2. The retention system according to claim 1, wherein the shape and location of the trench and the location of the holes are such that after mounting of the retention system there is substantially no gap between the wear part and the bucket body.

3. The retention system according to claim 1, wherein the force multiplier is an elongated body and wherein the trench is an elongated trench.

4. A retention system for a wear part for a bucket for an earth moving machine, the retention system comprising in operational use:

a bucket body comprising an edge and a trench, the trench having tilted sidewalls extending from an upper side of the bucket body, wherein a largest lateral dimension of the trench is at the upper side of the bucket body and a smallest lateral dimension of the trench is at a lower side of the bucket body opposite to the upper side, the tilted sidewalls each having elongated flat surfaces;

a force multiplier having a shape substantially corresponding to a shape of the trench including elongated tilted flat surfaces, wherein the force multiplier is provided with a through-hole in a first surface of the force multiplier, wherein the first surface is located at the upper side of the bucket body, the through-hole extending to a second surface at the lower side of the bucket body;

a wear part mounted to the edge of the bucket body, wherein the wear part forms a first mutual interface with the bucket body extending from the edge over a predefined distance along the lower side of the bucket body, wherein the wear part forms a second mutual interface with the edge of the bucket body, wherein the second mutual interface is under an angle with the first mutual interface, wherein the wear part is provided with a receiving hole located at a location corresponding to the through-hole in the force multiplier, and an axial force transmitter provided in the through-hole to secure the wear part to the force multiplier.

5. The retention system according to claim 4, wherein the shape and location of the trench and the location of the through-hole and the receiving hole are such that after mounting of the retention system there is substantially no gap between the wear part and the bucket body.

6. The retention system according to claim 4, wherein the force multiplier is an elongated body and wherein the trench is an elongated trench.

7. The retention system according to claim 4, wherein one of the wear part and the force multiplier is provided with at least one protrusion and another one of the wear part and the force multiplier is provided with at least one matching recess such that relative movement between the wear part and the force multiplier in a lateral direction parallel to the first mutual interface is prevented in operational use, for reducing shear forces acting on the axial force transmitter, and wherein the holes and the at least one protrusion are axially aligned.

8. The retention system according to claim 7, wherein the at least one protrusion comprises an elongated protrusion enclosing two or more receiving holes.

9. The retention system according to claim 7, wherein the at least one protrusion comprises two or more protrusions, each protrusion having at least one receiving hole.

10. The retention system according to claim 4, wherein the tilted flat surfaces of the force multiplier extend in the direction parallel to the edge a distance greater than a width of two through-holes.

11. The retention system according to claim 4, wherein the receiving hole in the wear part has inner threads.

12. The retention system according to claim 4, wherein the force multiplier includes opposing lateral ends and the tilted flat surfaces on the force multiplier are planar surfaces extending between the opposing lateral ends.

13. The retention system according to claim 4, wherein the wear part comprises a protrusion shaped and sized to extend into a bottom portion of the trench.

14. The retention system according to claim 13, wherein the protrusion is adjacent an opening to the through-hole.

15. The retention system according to claim 13, wherein the protrusion is an elongated protrusion adjacent to the through-hole.

16. The retention system according to claim 13, wherein the protrusion interfaces with the force multiplier.

17. The retention system according to claim 4, wherein the force multiplier comprises at least two through-holes, including the through-hole, and the wear part comprises at least two receiving holes, including the receiving hole, located at locations corresponding to the at least two through-holes in the force multiplier.

18. The retention system according to claim 4, wherein the force multiplier comprises a protrusion shaped and sized to extend from a bottom portion of the trench.

19. The retention system according to claim 18, wherein the protrusion is adjacent an opening to the through-hole.

20. The retention system according to claim 18, wherein the force multiplier comprises at least one hole and the protrusion is an elongated protrusion adjacent to the hole.

21. The retention system according to claim 18, wherein the protrusion interfaces with the wear part.

* * * * *